US005971894A

United States Patent [19]

Chen

[11] Patent Number: 5,971,894

[45] Date of Patent: Oct. 26, 1999

[54] STATIONARY EXERCISING BICYCLE

[76] Inventor: Ping Chen, No. 29, Nanmei St., Nantun Li, Natun Dist., Taichung, Taiwan

[21] Appl. No.: 09/094,306

[22] Filed: Jun. 9, 1998

[51] Int. Cl.[6] ..... A63B 21/00

[52] U.S. Cl. ..... 482/57; 482/908; 482/72

[58] Field of Search ..... 482/51, 52, 53, 482/57, 908, 70, 96, 72, 148; D21/191, 198

[56] References Cited

U.S. PATENT DOCUMENTS

| | | | |
|---|---|---|---|
| 3,750,479 | 8/1973 | Gause et al. | 482/57 |
| 4,700,946 | 10/1987 | Breunig | 482/57 |
| 5,356,358 | 10/1994 | Chen | 482/72 |
| 5,480,365 | 1/1996 | Lundin et al. | 482/53 |
| 5,533,953 | 7/1996 | Lui et al. | 482/96 |
| 5,601,505 | 2/1997 | Matsumoto | 482/57 |
| 5,692,994 | 12/1997 | Eschenbach | 482/57 |
| 5,769,760 | 6/1998 | Lin et al. | 482/57 |

*Primary Examiner*—Stephen R. Crow

*Attorney, Agent, or Firm*—Thomas, Kayden, Horstemeyer & Risley, L.L.P.

[57] ABSTRACT

An exercising bicycle includes a supporting base, a movable base slidably and adjustably secured to the supporting base, at least one pivot bar including a first end portion pivotally connected with the supporting base, a mediate portion and a second end portion, a supporting bar including a first end portion pivotally connected with the movable base and a second end portion pivotally connected with the mediate portion of the pivot bar, a seat mounted on the second end portion of the pivot bar, a transmission case mounted on the supporting base, a pedal member movably mounted on the transmission case, and a resistance device mounted in the transmission case for providing resistance to movement of the pedal member.

10 Claims, 8 Drawing Sheets

STATIONARY EXERCISING BICYCLE

FIELD OF THE INVENTION

The present invention relates to a stationary exercising bicycle.

BACKGROUND OF THE INVENTION

Sometimes, our exercise activities are restricted to being performed indoors due to the heavy traffic or bad weather, therefore, it is necessary to provide an exerciser which can be employed indoors for exercising purposes. The present invention has arisen to provide an exercising bicycle suitable for users of different stature.

SUMMARY OF THE INVENTION

In accordance with one aspect of the present invention, there is provided an exercising bicycle comprising a supporting base, a movable base slidably and adjustably secured to the supporting base, at least one pivot bar including a first end portion pivotally connected with the supporting base, a mediate portion and a second end portion, a supporting bar including a first end portion pivotally connected with the movable base and a second end portion pivotally connected with the mediate portion of the at least one pivot bar, a seat mounted on the second end portion of the at least one pivot bar, a transmission box mounted on the supporting base, a pedal means movably mounted on the transmission case, and a resistance means mounted in the transmission case for providing resistance to movement of the pedal means.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
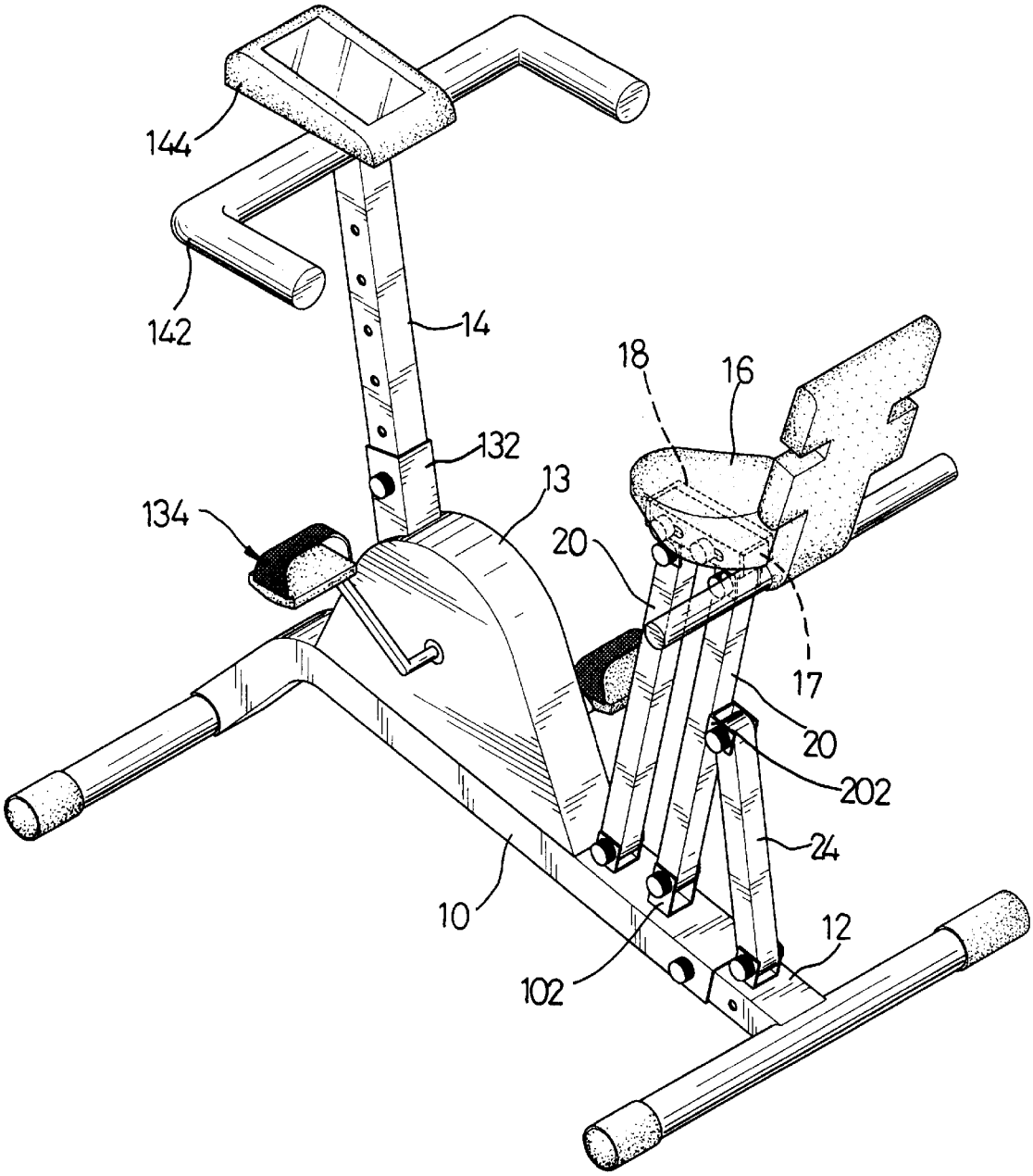
FIG. 1 is a perspective view of an exercising bicycle in accordance with a first embodiment of the present invention.

Referring now to FIGS. 1–4, an exercising bicycle in accordance with a first embodiment of the present invention comprises a stationary supporting base 10, a movable base 12 slidably and adjustably secured to the supporting base 10, two parallel pivot bars 20 each including a first end portion pivotally connected with the supporting base 10, a mediate portion and a second end portion, a supporting bar 24 including a first end portion pivotally connected with the movable base 12 and a second end portion pivotally connected with the mediate portion of one of the two pivot bars 20, a seat 16 mounted on the second end portion of each of the two pivot bars 20, a transmission case 13 fixedly mounted on the supporting base 10, a pedal means 134 movably mounted on the transmission case 13, and a resistance means (not shown) mounted in the transmission case 13 for providing resistance to movement of the pedal means 134.

The exercising bicycle further comprises a supporting post 132 fixedly mounted on the transmission case 13, an adjusting post 14 movably and adjustably mounted on the supporting post 132, a handle 142 fixedly mounted on the adjusting post 14, and a display 144 mounted on the handle 142.

A supporting block 17 is pivotally mounted on the second end portion of each of the two pivot bars 20, and an inverted U-shaped sliding bracket 18 is fixedly mounted on the bottom portion of the seat 16 and slidably secured to the supporting block 17.

The supporting block 17 transversely contains two through holes 170 therein, the sliding bracket 18 has two legs 181 each transversely contains two elongated slot 182 therein and each connecting to the respective through hole 170, two positioning bolts 180 each extend through the respective elongated slot 182 and the respective through hole 170, and two retaining nuts 184 are each engaged with the respective positioning bolt 180.

Two inverted U-shaped pivot brackets 172 are each fixedly mounted on a bottom portion of the supporting block 17 and are each pivotally connected with the second end portion of each of the pivot bars 20. Two bolts 174 each extend through the respective pivot bracket 172 and through the second end portion of the respective pivot bar 20, and two nuts 176 are each engaged with each of the two bolts 174.

Two U-shaped pivot brackets 102 are each fixedly mounted on the supporting base 10 and are each pivotally connected with the first end portion of each of the two pivot bars 20. A U-shaped pivot bracket 122 is fixedly mounted on the movable base 12 and is pivotally connected with the first end portion of the supporting bar 24. A U-shaped pivot bracket 202 is fixedly mounted on the mediate portion of one of the two pivot bars 20 and is pivotally connected with the second end portion of the supporting bar 24.

Figure 2:
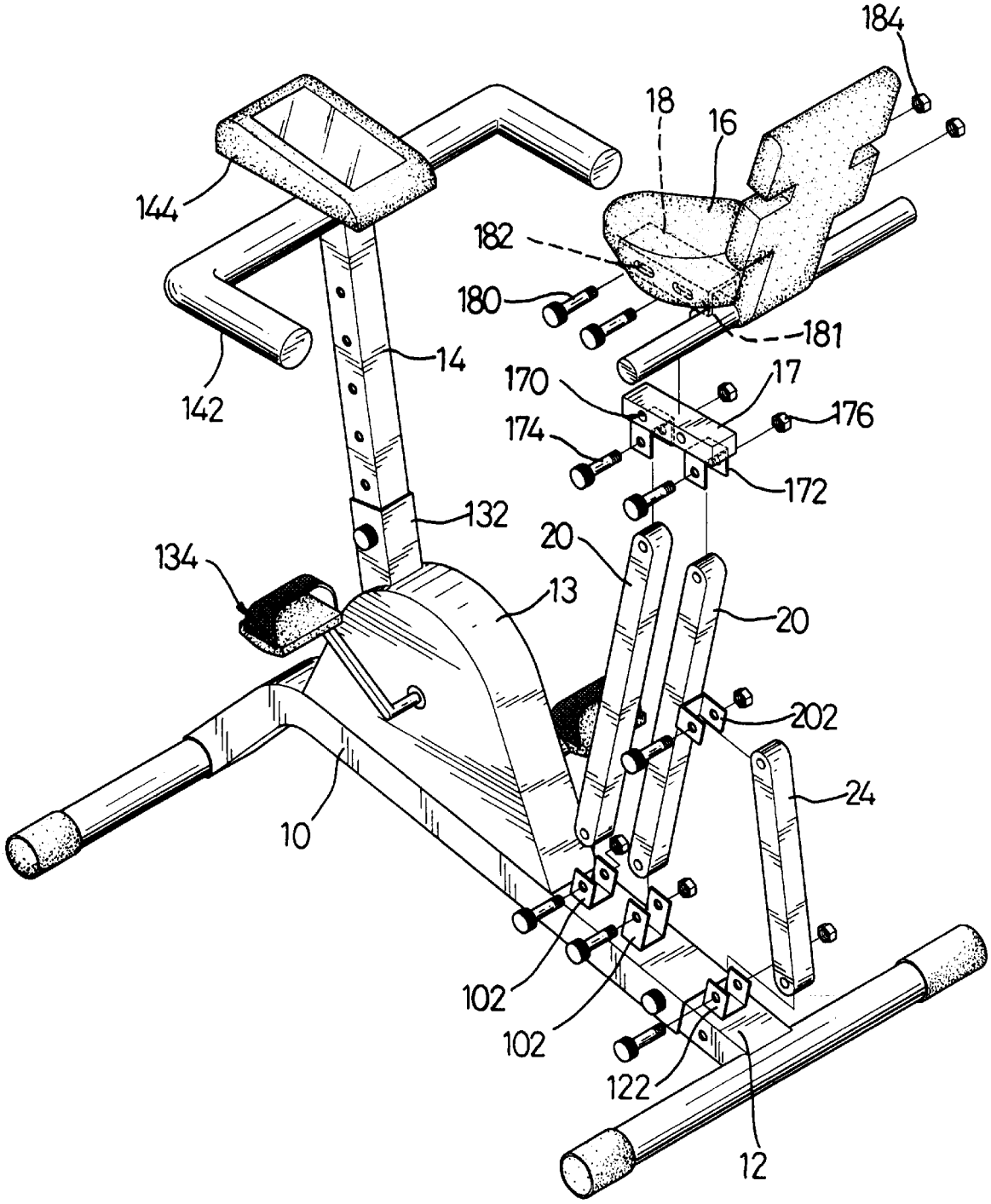
FIG. 2 is a partially exploded view of the exercising bicycle as shown in FIG. 1.
Figure 3:
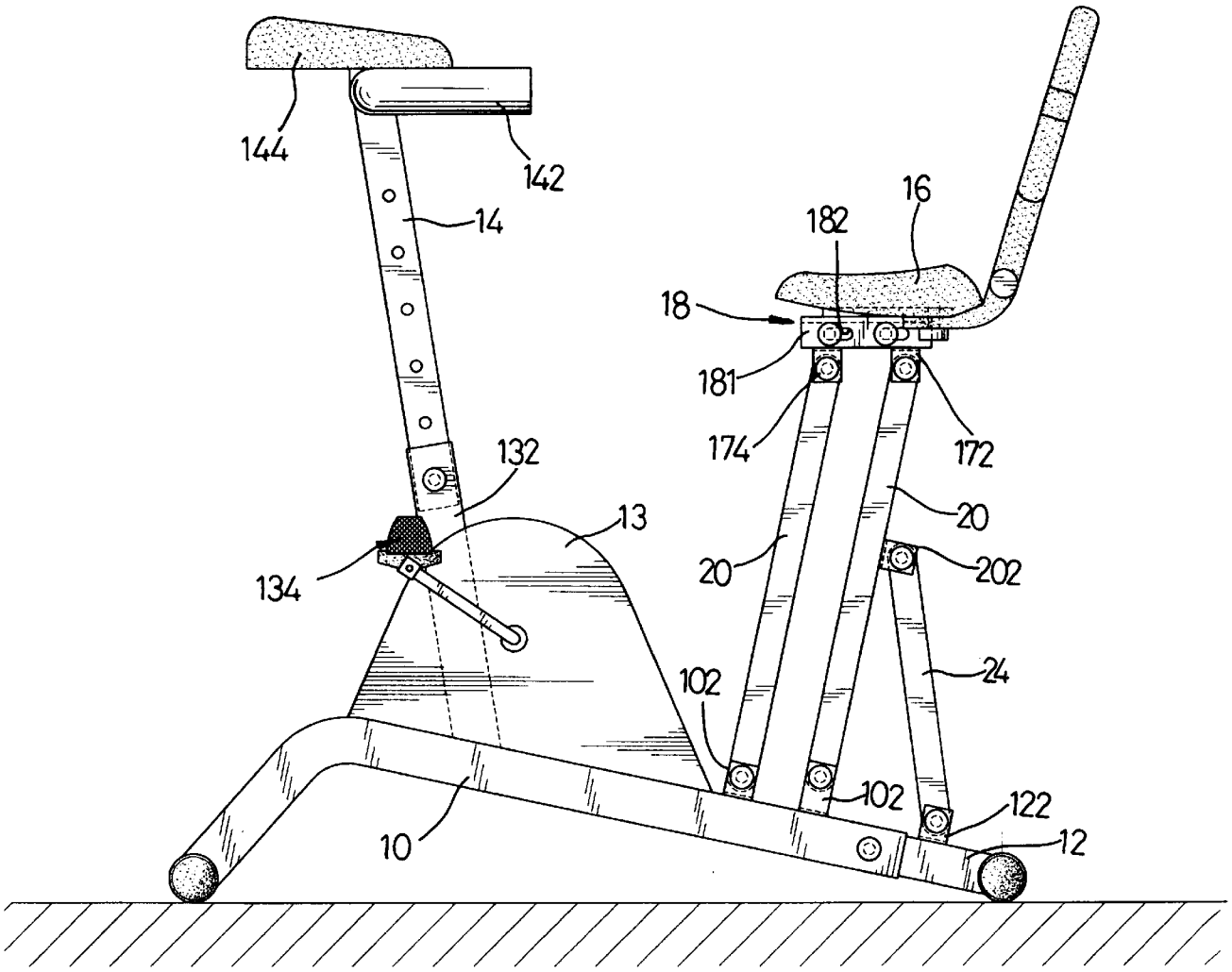
FIG. 3 is a front plan view of the exercising bicycle as shown in FIG. 1.
Figure 4:
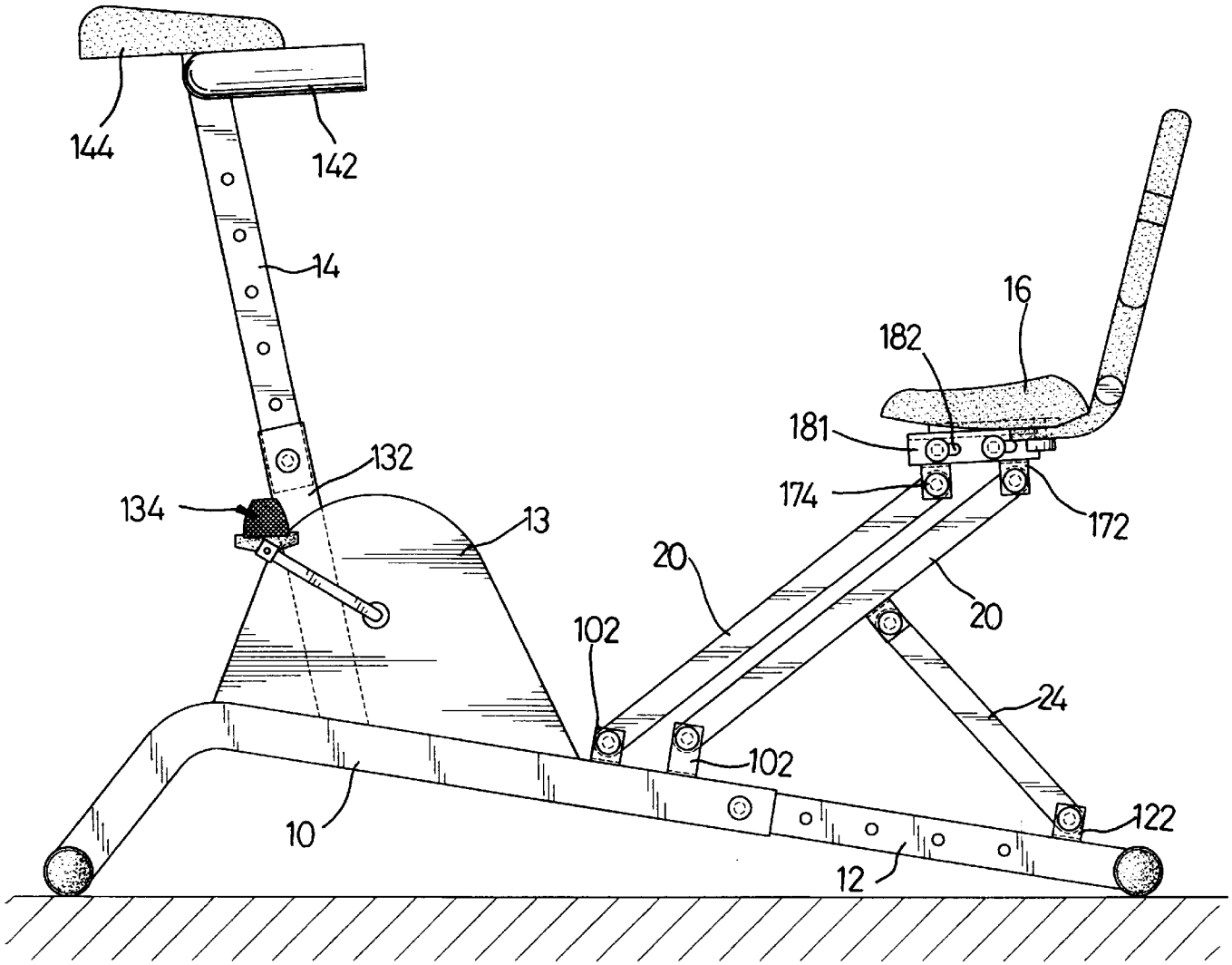
FIG. 4 is an operational view of the exercising bicycle as shown in FIG. 3.

In operation, referring to FIGS. 3 and 4 with reference to FIGS. 1 and 2, the movable base 12 can be moved outward relative to the supporting base 10 from a first position as shown in FIG. 3 to a second position as shown in FIG. 4 so as to displace the first end portion of the supporting bar 24 which can be pivoted relative to the movable base 12, thereby moving and pivoting each of the two pivot bars 20 relative to the supporting base 10 by means of the second end portion of the supporting bar 24, thereby lowering the seat 16 such that the height of the seat 16 can be arbitrarily adjusted so as to suit users of different stature and sizes.

Referring now to FIGS. 5–8, in accordance with a second embodiment of the present invention, the exercising bicycle comprises a pivot bar 26 including a first end portion pivotally connected with the supporting base 10 by means of the pivot bracket 102, a mediate portion pivotally connected with the second end portion of the supporting bar 24 by means of the pivot bracket 262, and a second end portion connected with the seat 16 which includes two inverted L-shaped extensions 164 extending downward from a bottom portion thereof.

A sleeve 264 is fixedly and vertically mounted on the second end portion of the pivot bar 26, an elongated retractable beam 27 includes a first portion slidably secured in the sleeve 264 and a second portion formed with a C-shaped clamp 272, a lifting rod 28 includes a first portion slidably secured in the clamp 272 and a second portion formed with a semi-circular supporting piece 282, two juxtaposed clamping blocks 29 are each pivotally mounted on the supporting piece 282 with each of the two extensions 164 of the seat 16 clamped therebetween, a semi-circular positioning piece 284 is mounted on one of the two clamping blocks 29 and is fixedly coupled with the supporting piece 282 by means of a plurality of positioning screws 286.

Figure 5:
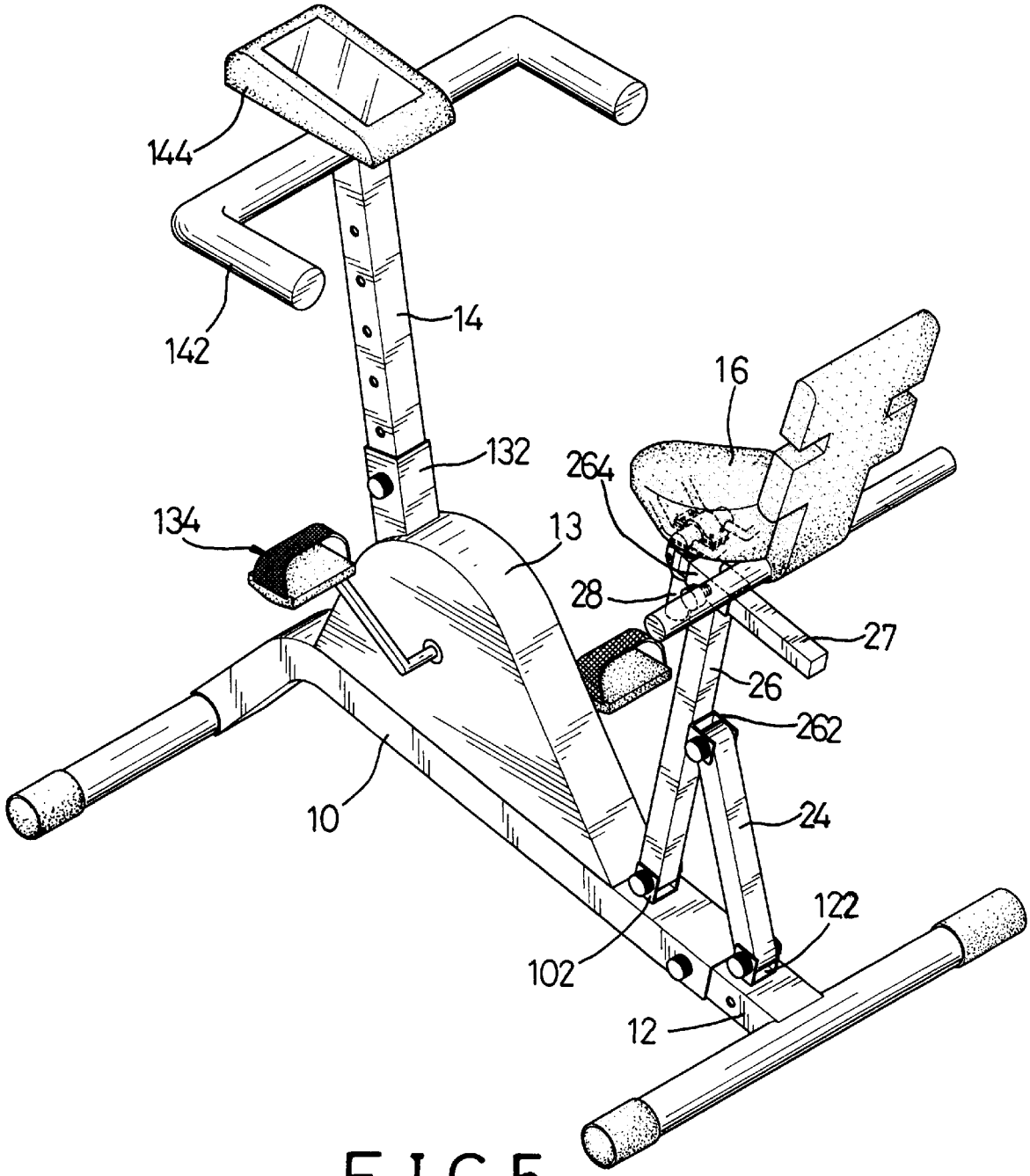
FIG. 5 is a perspective view of an exercising bicycle in accordance with a second embodiment of the present invention.
Figure 6:
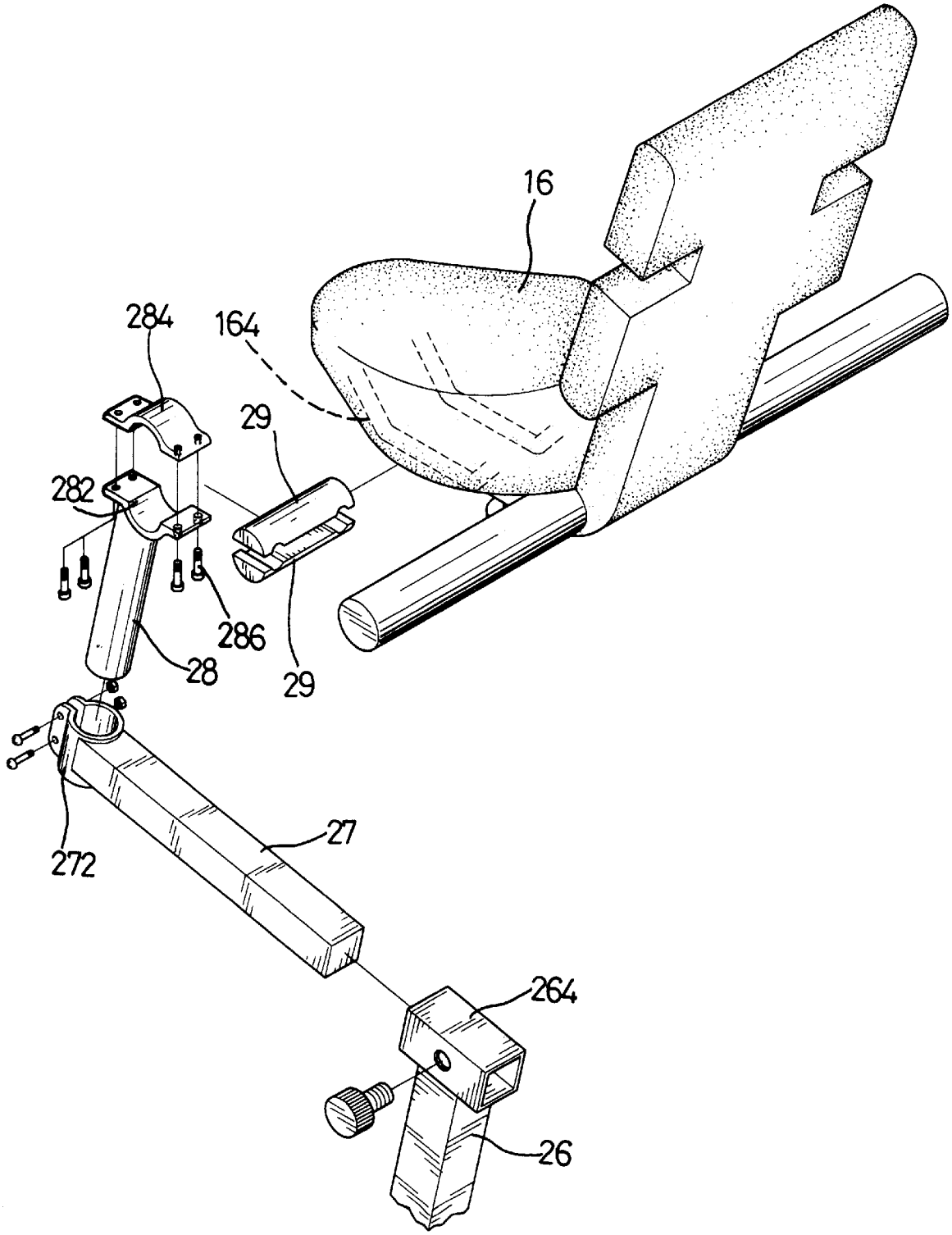
FIG. 6 is a partially cut-away exploded view of the exercising bicycle as shown in FIG. 5.
Figure 7:
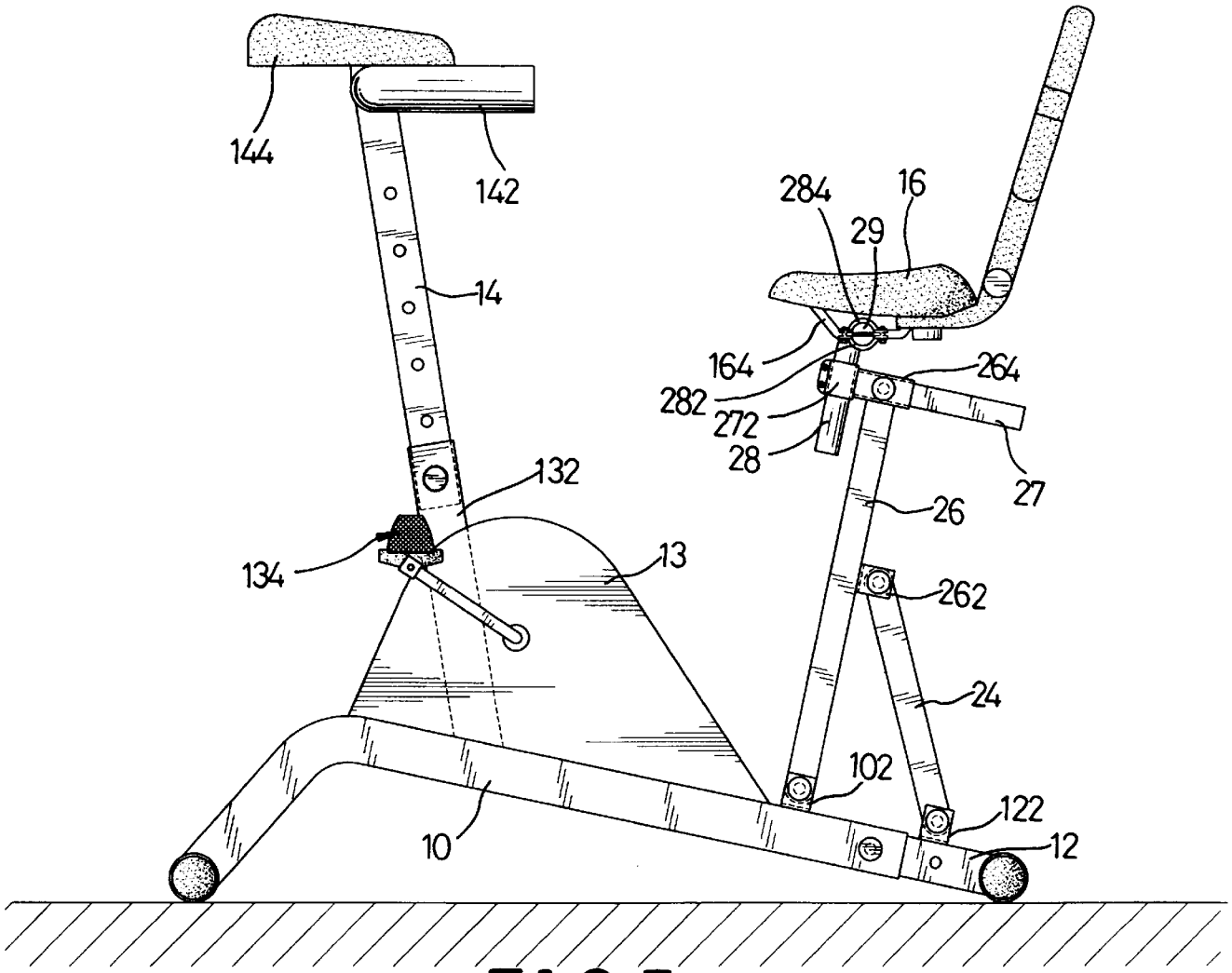
FIG. 7 is a front plan view of the exercising bicycle as shown in FIG. 5.
Figure 8:
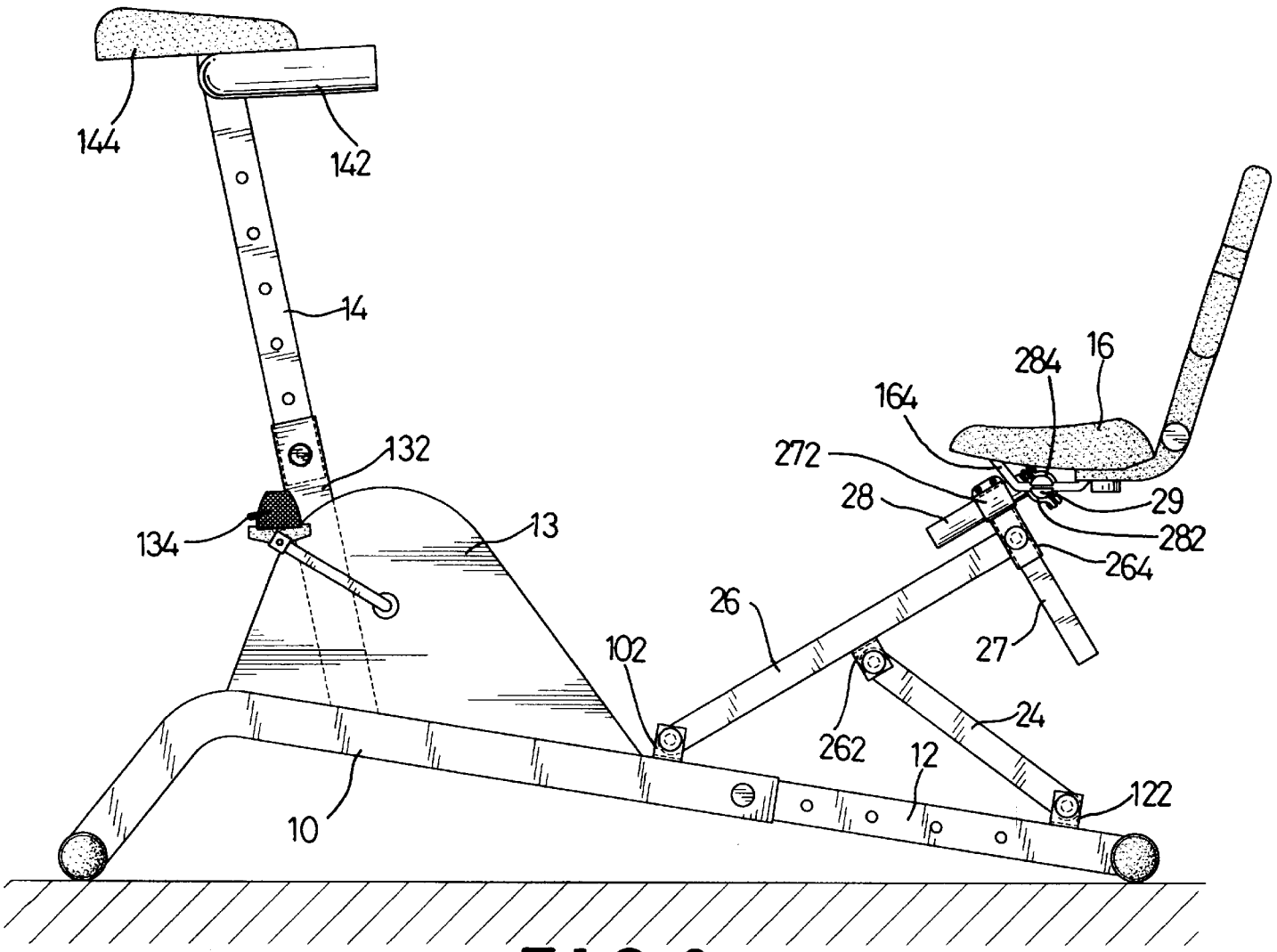
FIG. 8 is an operational view of the exercising bicycle as shown in FIG. 7.

In operation, referring to FIGS. 7 and 8 with reference to FIGS. 5 and 6, the movable base 12 can be moved outward relative to the supporting base 10 from a first position as shown in FIG. 7 to a second position as shown in FIG. 8 so as to displace the first end portion of the supporting bar 24 which can be pivoted relative to the movable base 12, thereby moving and pivoting the pivot bar 26 relative to the supporting base 10 by means of the second end portion of the supporting bar 24, thereby lowering the seat 16 such that the height of the seat 16 can be arbitrarily adjusted so as to suit users of different stature and sizes.

Each of the two juxtaposed clamping blocks 29 can be rotated between the supporting piece 282 and the positioning piece 284 when the positioning screws 286 are unscrewed to loosen the supporting piece 282 from the positioning piece 284, thereby in turn rotating the extensions 164 together with the seat 16 so as to adjust the inclined angle of the seat 16 such that the seat 16 can be placed in a horizontal manner as shown in FIG. 8.

It should be clear to those skilled in the art that further embodiments may be made without departing from the scope and spirit of the present invention.

What is claimed is:

1. An exercising bicycle comprising:

a supporting base (10);

a movable base (12) slidably and adjustably secured to said supporting base (10);

at least one pivot bar including a first end portion pivotally connected with said supporting base (10), a mediate portion and a second end portion;

a supporting bar (24) including a first end portion pivotally connected with said movable base (12) and a second end portion pivotally connected with said mediate portion of said at least one pivot bar;

a seat (16) mounted on said second end portion of said at least one pivot bar;

a transmission case (13) mounted on said supporting base (10);

pedal means (134) movably mounted on said transmission case (13); and resistance means mounted in said transmission case (13) for providing resistance to movement of said pedal means.

2. The exercising bicycle in accordance with claim 1, further comprising a supporting post (132) fixedly mounted on said transmission case (13), an adjusting post (14) movably mounted on said supporting post (132), a handle (142) fixedly mounted on said adjusting post (14), and a display (144) mounted on said handle (142).

3. The exercising bicycle in accordance with claim 1, wherein two parallel pivot bars (20) each have a first end portion pivotally connected with said supporting base (10) and a second end portion pivotally connected with said seat (16), and one of said two pivot bars (20) includes a mediate portion pivotally connected with said second end portion of said supporting bar (24).

4. The exercising bicycle in accordance with claim 3, further comprising a supporting block (17) pivotally mounted on said second end portion of each of said two pivot bars (20), and an inverted U-shaped sliding bracket (18) fixedly mounted on a bottom portion of said seat (16) and slidably secured to said supporting block (17).

5. The exercising bicycle in accordance with claim 4, wherein said supporting block (17) transversely contains at least one through hole (170) therein, said sliding bracket (18) has two legs (181) each transversely contains at least one elongated slot (182) therein and connecting to said through hole (170), and said exercising bicycle further comprises at least one positioning bolt (180) extending through said elongated slot (182) and said through hole (170), and at least one nut (184) engaged with said positioning bolt (180).

6. The exercising bicycle in accordance with claim 3, further comprising two U-shaped pivot brackets (102) each fixedly mounted on said supporting base (10) and each pivotally connected with said first end portion of each of said two pivot bars (20).

7. The exercising bicycle in accordance with claim 3, further comprising a U-shaped pivot bracket (122) fixedly mounted on said movable base (12) and pivotally connected with said first end portion of said supporting bar (24).

8. The exercising bicycle in accordance with claim 3, further comprising a U-shaped pivot bracket (202) fixedly mounted on said mediate portion of one of said two pivot bars (20) and pivotally connected with said second end portion of said supporting bar (24).

9. The exercising bicycle in accordance with claim 1, wherein a pivot bar (26) includes a first end portion pivotally connected with said supporting base (10), a mediate portion pivotally connected with said second end portion of said supporting bar (24), and a second end portion connected with said seat (16).

10. The exercising bicycle in accordance with claim 9, wherein said seat (16) includes two inverted L-shaped extensions (164) extending downward from a bottom portion thereof, and said exercising bicycle further comprises a sleeve (264) fixedly and vertically mounted on said second end portion of said pivot bar (26), an elongated retractable beam (27) including a first portion slidably secured in said sleeve (264) and a second portion formed with a C-shaped clamp (272), a lifting rod (28) including a first portion slidably secured in said clamp (272) and a second portion formed with a semi-circular supporting piece (282), two juxtaposed clamping blocks (29) pivotally mounted on said supporting piece (282) with each of said two extensions (164) of said seat (16) clamped therebetween, a semi-circular positioning piece (284) mounted on one of said two clamping blocks (29) and fixedly coupled with said supporting piece (282).

* * * * *